US010471713B2

(12) United States Patent
Oikawa et al.

(10) Patent No.: US 10,471,713 B2
(45) Date of Patent: Nov. 12, 2019

(54) INKJET PRINT HEAD AND INKJET PRINTING APPARATUS

(71) Applicant: CANON KABUSHIKI KAISHA, Tokyo (JP)

(72) Inventors: Satoshi Oikawa, Yokohama (JP); Tatsurou Mori, Yokohama (JP); Shingo Okushima, Kawasaki (JP); Satoshi Kimura, Kawasaki (JP); Kengo Umeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/947,129

(22) Filed: Apr. 6, 2018

(65) Prior Publication Data

US 2018/0333955 A1 Nov. 22, 2018

(30) Foreign Application Priority Data

May 16, 2017 (JP) ..... 2017-097416

(51) Int. Cl.

| | |
|---|---|
| ***B41J 2/015*** | (2006.01) |
| ***B41J 2/14*** | (2006.01) |
| ***B41J 2/045*** | (2006.01) |
| *B41J 2/01* | (2006.01) |

(52) U.S. Cl.

CPC ..... *B41J 2/14* (2013.01); *B41J 2/04541* (2013.01); *B41J 2/14024* (2013.01); *B41J 2/14072* (2013.01); *B41J 2002/012* (2013.01); *B41J 2002/14491* (2013.01); *B41J 2202/12* (2013.01); *B41J 2202/19* (2013.01); *B41J 2202/20* (2013.01)

(58) Field of Classification Search

None

See application file for complete search history.

(56) References Cited

U.S. PATENT DOCUMENTS

| | | | | |
|---|---|---|---|---|
| 6,180,018 | B1 | 1/2001 | Miyagawa et al. | 216/27 |
| 6,302,504 | B1 | 10/2001 | Imanaka et al. | 347/9 |
| 6,315,853 | B1 | 11/2001 | Kubota et al. | 156/257 |
| 6,609,782 | B2 | 8/2003 | Mori | 347/50 |
| 6,629,755 | B2 | 10/2003 | Saito et al. | 347/58 |
| 6,945,622 | B2 | 9/2005 | Sakurai | 347/5 |
| 7,115,975 | B2 | 10/2006 | Mori | 257/668 |

(Continued)

FOREIGN PATENT DOCUMENTS

| | | | |
|---|---|---|---|
| JP | 2007-268867 A | | 10/2007 |
| JP | 2010036454 A | * | 2/2010 |

OTHER PUBLICATIONS

U.S. Appl. No. 15/837,470, filed Dec. 11, 2017.

(Continued)

*Primary Examiner* — Matthew Luu
*Assistant Examiner* — Tracey M McMillion
(74) *Attorney, Agent, or Firm* — Venable LLP

(57) ABSTRACT

An inkjet print head includes an ejection module having a printing element substrate that ejects ink to a print medium and a flexible wiring substrate electrically connected to the printing element substrate; and a member for supporting the ejection module by joining, wherein the flexible wiring substrate has a capacitor, a periphery of the capacitor being covered with a sealing agent, and the capacitor is provided in a recess formed on the member.

19 Claims, 11 Drawing Sheets

(56) References Cited

U.S. PATENT DOCUMENTS

| | | | | |
|---|---|---|---|---|
| 7,316,469 | B2 * | 1/2008 | Chikamoto | B41J 2/14209 347/68 |
| 7,354,125 | B2 | 4/2008 | Hirayama et al. | 347/12 |
| 7,815,272 | B2 | 10/2010 | Kasai et al. | 347/12 |
| 7,896,474 | B2 | 3/2011 | Kasai et al. | 347/56 |
| 7,918,538 | B2 | 4/2011 | Sakurai | 347/57 |
| 8,052,251 | B2 | 11/2011 | Kudo et al. | 347/65 |
| 8,147,039 | B2 | 4/2012 | Kurokawa et al. | 347/56 |
| 8,523,325 | B2 | 9/2013 | Sakurai et al. | 347/50 |
| 8,529,003 | B2 | 9/2013 | Sakurai | 347/9 |
| 8,746,847 | B2 | 6/2014 | Kishikawa et al. | 347/50 |
| 8,757,771 | B2 | 6/2014 | Tsuchii et al. | 347/40 |
| 9,033,457 | B2 | 5/2015 | Oikawa et al. | 347/20 |
| 9,039,144 | B2 | 5/2015 | Umeda | 347/50 |
| 9,221,257 | B2 | 12/2015 | Moriya et al. | B41J 2/14145 |
| 9,221,258 | B2 | 12/2015 | Akama et al. | B41J 2/1433 |
| 9,238,361 | B2 | 1/2016 | Muraoka et al. | B41J 2/01 |
| 9,248,650 | B2 | 2/2016 | Muraoka et al. | B41J 2/1433 |
| 9,266,329 | B2 | 2/2016 | Kuroda et al. | B41J 2/1433 |
| 9,283,748 | B2 | 3/2016 | Umeda et al. | B41J 2/04563 |
| 9,365,043 | B2 | 6/2016 | Toda et al. | B41J 2/1752 |
| 9,370,928 | B2 | 6/2016 | Toda et al. | B41J 2/14072 |
| 9,375,920 | B2 | 6/2016 | Akama et al. | B41J 2/14072 |
| 9,446,592 | B2 | 9/2016 | Seki et al. | B41J 2/1433 |
| 9,457,566 | B2 | 10/2016 | Kuroda et al. | B41J 2/14024 |
| 9,475,288 | B2 | 10/2016 | Kudo et al. | B41J 2/14 |
| 9,592,668 | B2 | 3/2017 | Kuroda et al. | B41J 2/1433 |
| 9,597,870 | B2 | 3/2017 | Sakurai et al. | B41J 2/14072 |
| 9,616,664 | B2 | 4/2017 | Oikawa et al. | B41J 2/21 |
| 9,724,919 | B2 | 8/2017 | Hirayama et al. | B41J 2/04506 |
| 9,731,504 | B2 | 8/2017 | Sekine et al. | B41J 2/1408 |
| 9,751,310 | B2 | 9/2017 | Karita et al. | B41J 2/1623 |
| 9,962,937 | B2 | 5/2018 | Okushima et al. | B41J 2/155 |
| 2014/0327717 | A1 * | 11/2014 | Umeda | B41J 2/04563 347/17 |
| 2017/0197439 | A1 | 7/2017 | Okushima et al. | B41J 2/185 |
| 2017/0232737 | A1 | 8/2017 | Komamiya et al. | 347/17 |
| 2017/0274647 | A1 | 9/2017 | Aoki et al. | B41J 2/0458 |
| 2017/0313076 | A1 | 11/2017 | Okushima et al. | B41J 2/155 |
| 2017/0326875 | A1 | 11/2017 | Nakakubo et al. | B41J 2/04535 |
| 2017/0341379 | A1 | 11/2017 | Umeda et al. | B41J 2/04548 |
| 2017/0341398 | A1 | 11/2017 | Tamenaga et al. | B41J 2/16505 |

OTHER PUBLICATIONS

U.S. Appl. No. 15/992,667, filed May 30, 2018.
U.S. Appl. No. 15/976,470, filed May 10, 2018.
U.S. Appl. No. 15/936,664, filed Mar. 27, 2018.
U.S. Appl. No. 15/942,891, filed Apr. 2, 2018.

* cited by examiner

INKJET PRINT HEAD AND INKJET PRINTING APPARATUS

BACKGROUND OF THE INVENTION

Field of the Invention

The present invention relates to an inkjet print head and an inkjet printing apparatus.

Description of the Related Art

Recently, a so-called full-line print head having a plurality of element substrates and having a printing width that is greater than the width of a print medium has been offered. The full-line print head is an elongate print head. Accordingly, the wiring length of driving power source wiring from a power source circuit or a capacitor to an element substrate and the wiring length of ground wiring also lengthen. As the wiring becomes longer, a parasitic inductance component of the wiring increases. As a result, passage of a large amount of current causes ringing. The ringing temporarily generates a potential difference between the ground wiring for a heating resistor and the ground wiring for an element substrate. The potential difference causes a parasitic transistor of a field-effect transistor, which is a drive element, to be switched on, resulting in passage of a large amount of current at an A (ampere) level through the parasitic transistor, which may cause the drive element to malfunction.

Japanese Patent Laid-Open No. 2007-268867 (hereinafter referred to as PTL 1) discloses a technique of locating a capacitor in the vicinity of a printing element substrate to avoid such a malfunction.

However, it is very likely that the vicinity of the printing element substrate of the inkjet print head will be contaminated with ink. In a case where the capacitor is located in such a position, adhesion of the ink to a capacitor implementation part may cause a short. In PTL 1, the capacitor is housed in a position surrounded by components, which is somewhat effective at preventing the ink contamination. However, entry of ink may occur through a gap between the components.

Furthermore, in the technique disclosed in PTL 1, a space exists around the capacitor. Therefore, external shock of mechanical loads on the capacitor cannot be absorbed, such as shock of vibrations or a drop during transportation or use.

SUMMARY OF THE INVENTION

According to an aspect of the present invention, there is provided an inkjet print head including an ejection module having a printing element substrate that ejects ink to a print medium and a flexible wiring substrate electrically connected to the printing element substrate; and a member for supporting the ejection module by joining, wherein the flexible wiring substrate has a capacitor, a periphery of the capacitor being covered with a sealing agent, and the capacitor is provided in a recess formed on the member.

Further features of the present invention will become apparent from the following description of exemplary embodiments with reference to the attached drawings.

DESCRIPTION OF THE EMBODIMENTS

Examples of the embodiments of the present invention will be described with reference to the drawings. However, the following description should not limit the scope of the present invention. In the present embodiment, description will be given of an example of a thermal system that generates bubbles by using a heat generating element for generating energy and ejects liquid. However, the present invention is also applicable to an inkjet print head (hereinafter also referred to as "a liquid ejection head") that employs a piezoelectric system or various other liquid ejection systems.

In the present embodiment, description will be given of an example of an inkjet printing apparatus (hereinafter referred to as "a printing apparatus") having an aspect that liquid such as ink circulates through a tank and a liquid ejection head, but the inkjet printing apparatus may have another aspect. For instance, instead of circulating ink, tanks may be provided in both upstream and downstream sides of the liquid ejection head to pass the ink from one tank to the other tank, thereby causing the ink inside a pressure chamber to flow.

In the present embodiment, an example of a so-called line type print head having a length corresponding to the width of a print medium will be described. However, the present invention is also applicable to a so-called serial type liquid ejection head, which performs printing while moving relative to a print medium. Examples of the serial type liquid ejection heads include one with a configuration of mounting one printing element substrate for black ink and one printing element substrate for color ink, but the present invention is not limited to this. A line head having a length shorter than the width of a print medium, configured to have several printing element substrates arranged thereon such that ejection ports overlap each other in a direction of ejection port arrays, may be formed and the line head may be caused to move relative to the print medium.

First Embodiment

<Description of the Inkjet Printing Apparatus>

Figure 1:
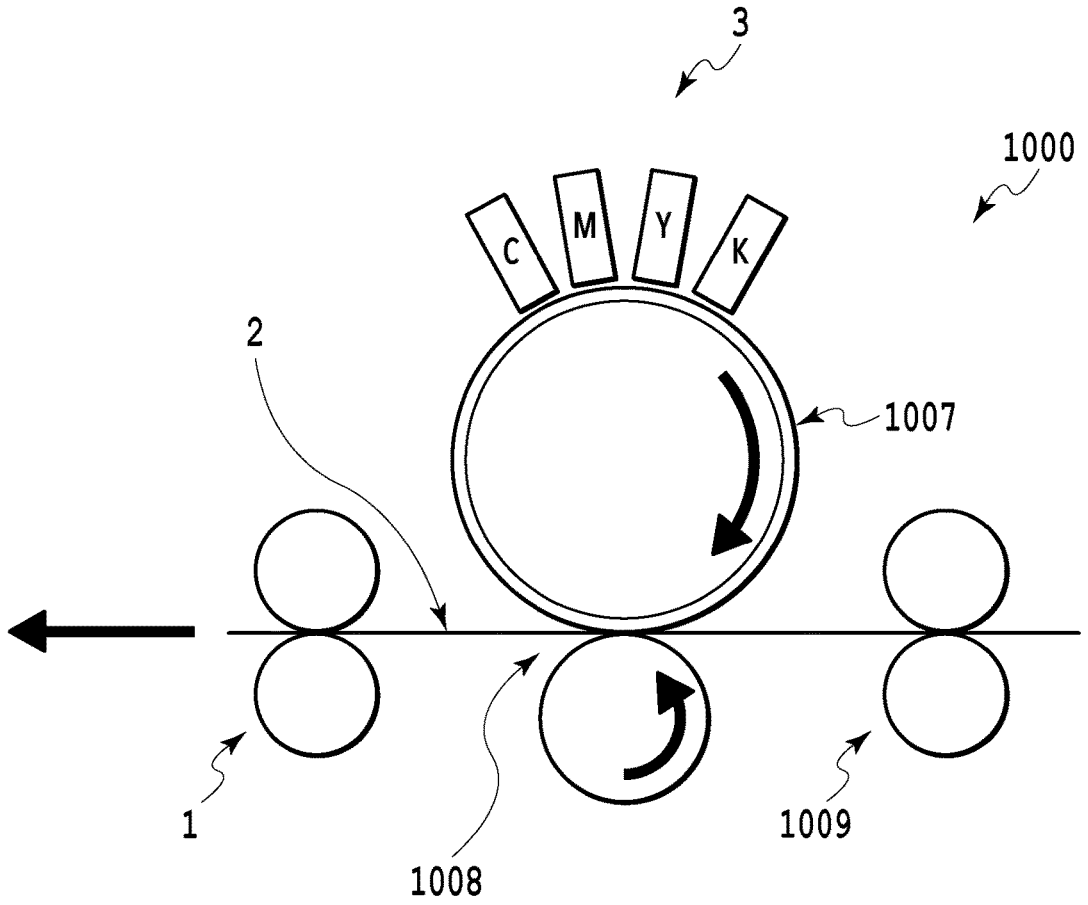
FIG. 1 is a schematic diagram of an inkjet printing apparatus.

FIG. 1 is a diagram showing a schematic configuration of an apparatus that ejects liquid according to the present embodiment, more specifically, an inkjet printing apparatus 1000 (hereinafter also referred to as a printing apparatus)

that performs printing by ejecting ink. The printing apparatus 1000 has a conveying unit 1 for conveying a print medium 2 and a line type (page wide type) liquid ejection head 3 provided substantially perpendicular to a conveying direction of the print medium. The printing apparatus 1000 is a line type printing apparatus that performs continuous printing in one pass while continuously or intermittently conveying a plurality of print media 2. The print medium 2 is not limited to a cut sheet, but may be continuous roll paper. The liquid ejection head 3 enables full-color printing using CMYK inks (cyan, magenta, yellow, and black).

The printing apparatus 1000 does not cause the liquid ejection head 3 to directly print on the print medium, but causes the liquid ejection head 3 to first eject liquid to an intermediate transfer body (an intermediate transfer drum 1007), forms an image, and then transfers the image to the print medium 2. In the printing apparatus 1000, four liquid ejection heads 3 each for a single color corresponding to four types of inks, CMYK, are arranged along an arc of the intermediate transfer drum 1007. Ink is ejected from the liquid ejection head 3 onto the intermediate transfer body, thereby performing full-color printing on the intermediate transfer body. The printed image is appropriately dried on the intermediate transfer body, and then transferred by a transfer unit 1008 to the print medium 2 that is conveyed by a sheet conveying roller 1009. A sheet conveying system may also be horizontal conveyance mainly aimed at a cut sheet or may also be adapted for continuous paper fed from a main roll (not shown). To each liquid ejection head 3, a buffer tank 1003 and a main tank 1006 (described later with reference to FIG. 2), which form a supply system of the printing apparatus 1000, are connected in a fluid manner. Further, to each liquid ejection head 3, an electrical control unit for transmitting power and ejection control signals to the liquid ejection head 3 is electrically connected.

It should be noted that description will be given of an example of an aspect that, as shown in FIG. 1, the printing apparatus 1000 according to the present embodiment forms an image on the intermediate transfer body and then transfers the image to the print medium 2, but the present invention is not limited to this. The present invention is also applicable to an inkjet printing apparatus in which a print head ejects liquid to a print medium to perform printing. CMYK are described as the examples of the inks to be mounted, but the present invention is not limited to this. Various types of inks such as a light-color ink and a clear ink may also be mounted.

<Description of a Circulation Path>

Figure 2:
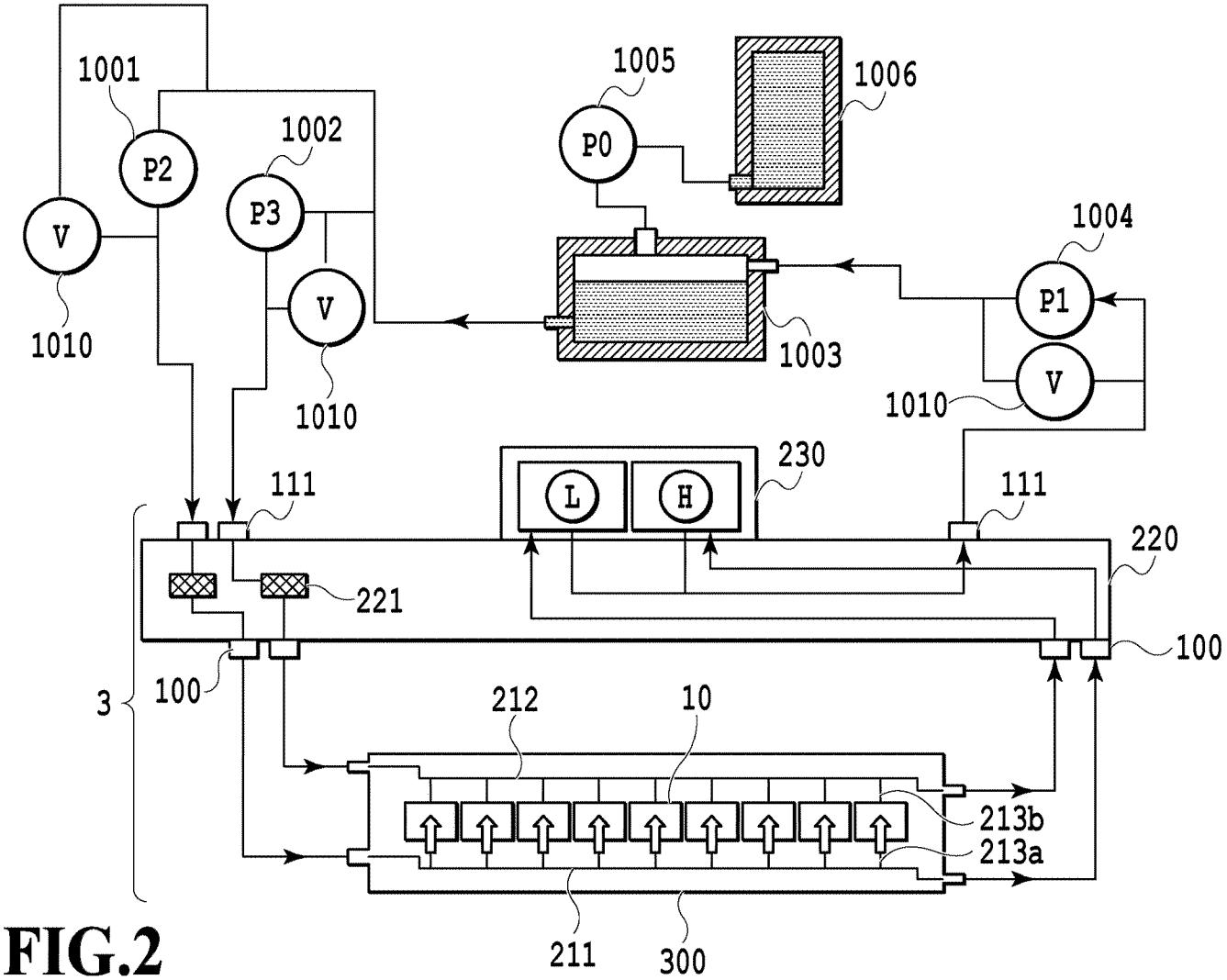
FIG. 2 is a schematic diagram showing a liquid circulation path.

FIG. 2 is a schematic diagram showing a liquid circulation path between the tank and the liquid ejection head 3 of the printing apparatus 1000 according to the present embodiment. FIG. 2 shows fluid connection of the liquid ejection head 3 to a first circulation pump (a high-pressure side) 1001, a first circulation pump (a low-pressure side) 1002, a buffer tank 1003, and so on. For simplicity of explanation, FIG. 2 shows only a path in which one of CMYK inks flows, but in actuality circulation paths for four colors are provided on the liquid ejection heads 3, respectively, and the printing apparatus body. The buffer tank 1003 as a sub-tank connected to the main tank 1006 has an atmosphere communication port (not shown) that communicates the inside and the outside of the tank, and is capable of discharging bubbles in the ink to the outside. The buffer tank 1003 is also connected to a fill-in pump 1005. In a case where liquid is consumed in the liquid ejection head 3 through the ejection (discharging) of ink from ejection ports of the liquid ejection head, such as printing by ink ejection or suction recovery, the fill-in pump 1005 transfers ink from the main tank 1006 to the buffer tank 1003 in an amount corresponding to the consumed ink. The first circulation pumps 1001, 1002 serve to pass the liquid in the buffer tank 1003 to the liquid ejection head 3. For the first circulation pump, a positive-displacement pump having a quantitative delivery capacity is preferably used. Specific examples of the positive-displacement pump include a tube pump, a gear pump, a diaphragm pump, a syringe pump, and the like. A constant flow rate may be secured by providing a typical constant flow valve or relief valve on a pump outlet, for example. Upon driving a liquid ejection unit 300, the first circulation pump (high-pressure side) 1001 and the first circulation pump (low-pressure side) 1002 cause ink in a constant amount to flow through a common supply flow path 211 and a common collection flow path 212, respectively.

A negative pressure control unit 230 is provided in a path between a second circulation pump 1004 and the liquid ejection unit 300. The negative pressure control unit 230 operates to keep pressure variations on its upstream side (i.e., a side of the liquid ejection unit 300) within a constant range even if change in a print duty causes change in a flow rate in the case of printing by the liquid ejection head 3. More specifically, the negative pressure control unit 230 operates to keep pressure variations within a constant range around a preset pressure. For two pressure adjusting mechanisms forming the negative pressure control unit 230, mechanisms that control a pressure upstream from the negative pressure control unit 230 so that its variations are within the constant range around a desired preset pressure (mechanism components having the same function as a so-called "back-pressure regulator") may be used, for example. The second circulation pump 1004 functions as a negative pressure source that reduces a pressure downstream from the negative pressure control unit 230.

The negative pressure control unit 230 has two pressure adjusting mechanisms in which different control pressures are set, respectively. Of the two negative pressure adjusting mechanisms, one having a high-pressure setting (denoted by H in FIG. 2) and one having a low-pressure setting (denoted by L in FIG. 2) are respectively connected to the common supply flow path 211 and the common collection flow path 212 in the liquid ejection unit 300 via a liquid supply unit 220. The liquid ejection unit 300 has the common supply flow path 211, the common collection flow path 212, and an individual supply flow path 213*a* and an individual collection flow path 213*b* that communicate with each printing element substrate. Since an individual flow path 213 communicates with the common supply flow path 211 and the common collection flow path 212, there are flows (arrows in FIG. 2) of the liquid partially passing through the internal flow path of the printing element substrate 10 from the common supply flow path 211 into the common collection flow path 212. This is caused by a pressure difference between two common flow paths formed by connection of the pressure adjusting mechanism H to the common supply flow path 211 and connection of the pressure adjusting mechanism L to the common collection flow path 212. In this manner, the liquid ejection unit 300 produces such flows that the liquid passes through each of the common supply flow path 211 and the common collection flow path 212 while part of the liquid passes through each printing element substrate 10. This allows heat generated in each printing element substrate 10 to be discharged outside the printing element substrate 10 while flowing in the common supply flow path 211 and the common collection flow path 212. While the liquid ejection head 3 is printing, this configuration can also produce an ink flow in ejection ports not performing printing and a pressure chamber, thereby preventing ink from thickening in a relevant part. It can also discharge thickened ink or foreign matter in the ink to the common collection flow path 212.

In the circulation path of FIG. 2, bypass valves 1010 communicating with the respective flow paths of the first circulation pumps 1001, 1002 and the second circulation pump 1004 are added. The bypass valve 1010 has a first function of reducing a pressure upstream from the bypass valve 1010 by opening the valve in a case where a pressure exceeds a preset pressure. The bypass valve 1010 also has a second function of opening and closing the valve at any timing in response to a signal from a control substrate of the printing apparatus body.

It should be noted that the circulation path is not limited to the above example. A circulation path without the bypass valve 1010 may also be used. A circulation path that causes ink to flow in an opposite way to the above-described flow path may also be used. That is, ink may flow from the negative pressure control unit 230 to the liquid ejection head 3.

<Description of the Structure of the Liquid Ejection Head>

Figure 3A:
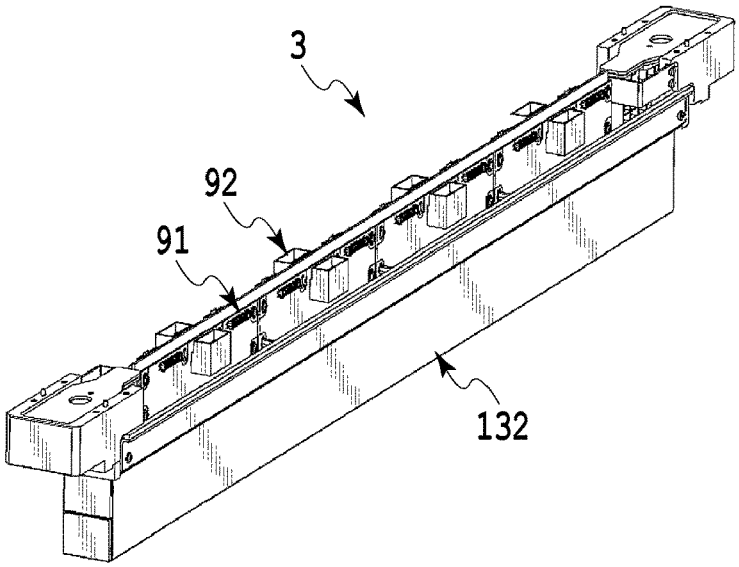
FIGS. 3A and 3B are views illustrating the structure of a liquid ejection head.
Figure 3B:
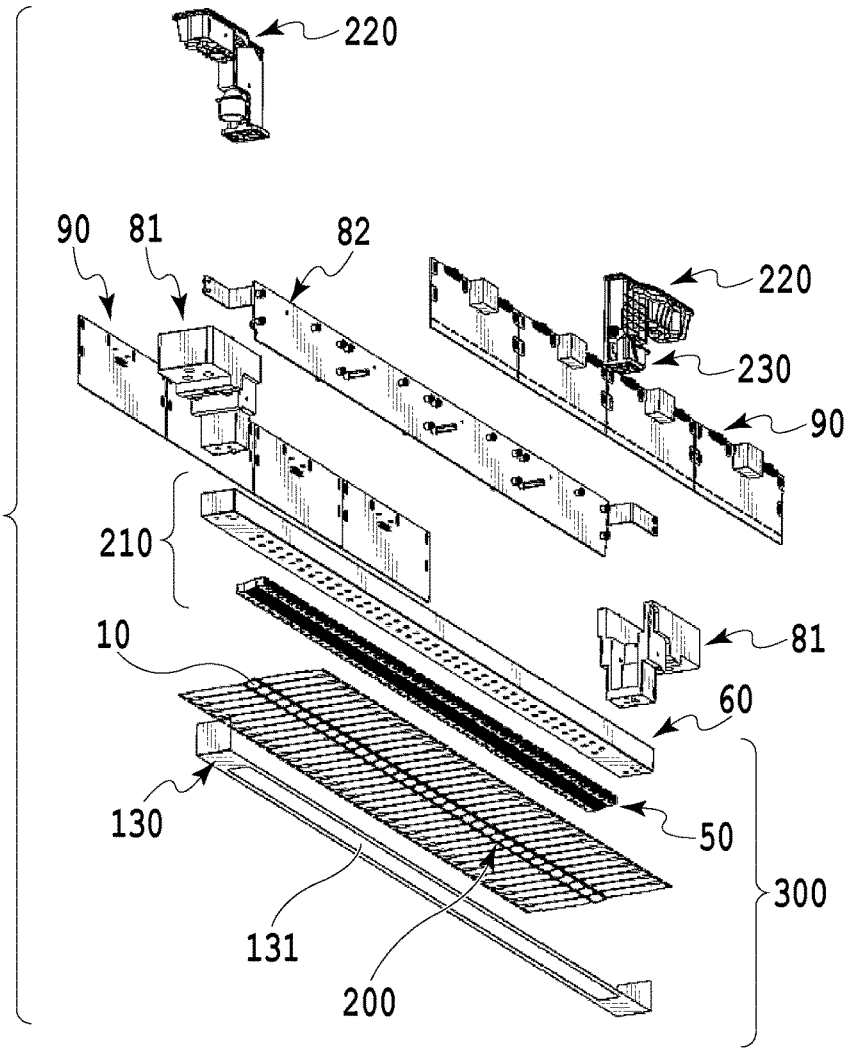

FIGS. 3A and 3B are views illustrating the structure of the liquid ejection head 3. FIG. 3A is a perspective view of the liquid ejection head 3 according to the present embodiment. FIG. 3B is an exploded perspective view of the liquid ejection head 3. The liquid ejection head 3 is a page wide type print head of an inkjet system having 36 printing element substrates 10 (FIG. 2) arrayed in line in a longitudinal direction of the liquid ejection head 3. On each side of the liquid ejection head 3, a signal output terminal 91 and a power supply terminal 92 are provided. The liquid ejection head 3 is also provided with a shield plate 132 for protecting a longitudinal side surface of the head.

FIG. 3B is an exploded perspective view of the liquid ejection head 3 and shows components or units forming the liquid ejection head 3 that are divided according to their functions (the shield plate 132 is not shown). A second flow path member 60 included in the liquid ejection unit 300 ensures rigidity of the liquid ejection head 3. A liquid ejection unit supporting part 81 is connected to each end of the second flow path member 60. The liquid ejection unit supporting part 81 is mechanically coupled to a carriage of the printing apparatus 1000 for positioning of the liquid ejection head 3. The liquid supply unit 220 having the negative pressure control unit 230 and an electrical wiring substrate 90 are coupled to the liquid ejection unit supporting part 81. A filter (not shown) is installed in each of the two liquid supply units 220. The two negative pressure control units 230 are configured to control pressure under relatively high and low negative pressures that are different from each other.

Next, a flow path member 210 of the liquid ejection unit 300 will be described in detail. As shown in FIG. 3B, the flow path member 210 is formed by laminating a first flow path member 50 and a second flow path member 60. The flow path member 210 dispenses liquid supplied from the liquid supply unit 220 to each ejection module 200. Further, the flow path member 210 functions as a flow path member that returns the liquid flowing back from the ejection module 200 to the liquid supply unit 220. The second flow path member 60 of the flow path member 210 is a flow path member having the common supply flow path 211 and the common collection flow path 212 formed therein and mainly serves to ensure rigidity of the liquid ejection head 3.

As shown in FIG. 3B, eight electrical wiring substrates 90 are provided. Four electrical wiring substrates 90 are attached to each side surface of an elongate electrical wiring substrate supporting part 82 attached to the liquid ejection unit supporting part 81.

<Description of the Ejection Module>

Figure 4A:
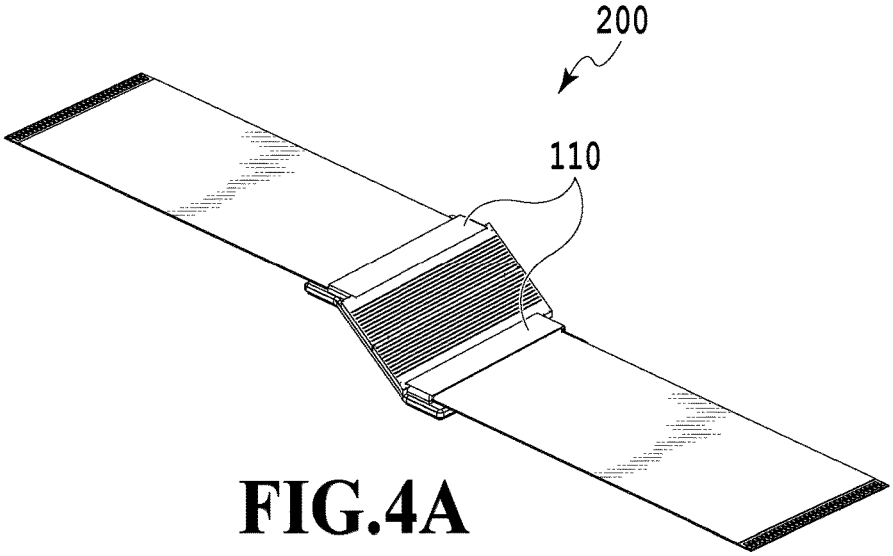
FIGS. 4A and 4B are views illustrating an ejection module.
Figure 4B:
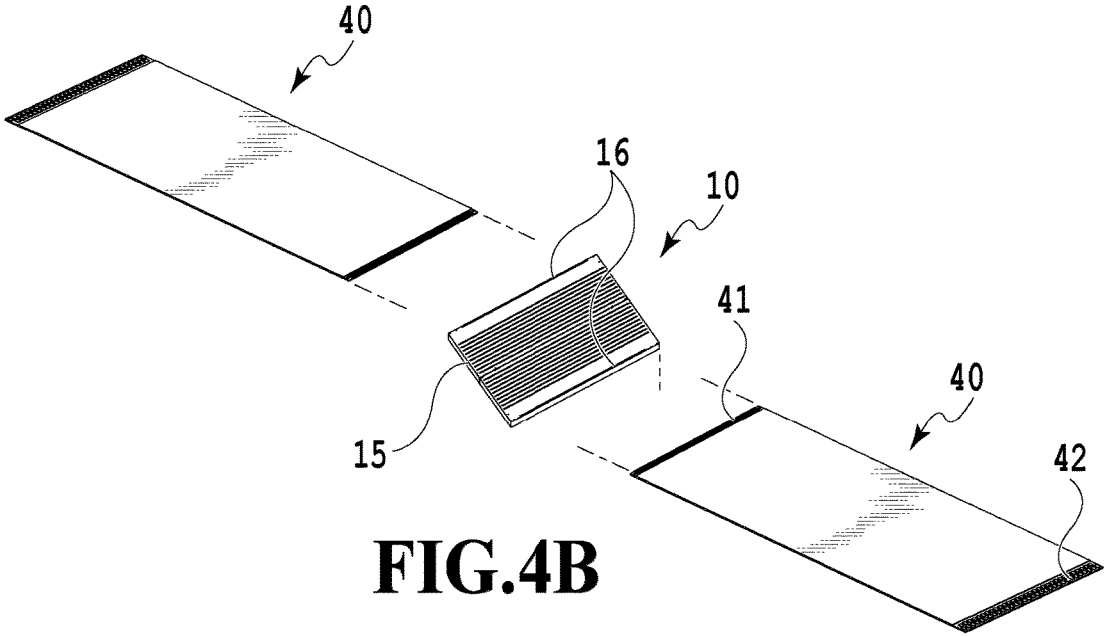

FIGS. 4A and 4B are views illustrating the ejection module. FIG. 4A is a perspective view of one ejection module 200. FIG. 4B is an exploded view of the ejection module 200. As shown in FIGS. 4A and 4B, side portions along a direction of a plurality of ejection port arrays of the printing element substrate 10 (long side portions of the printing element substrate 10) are provided with a plurality of terminals 16. For one printing element substrate 10, two flexible wiring substrates 40 each electrically connected to the terminal 16 are arranged. This aims to reduce a maximum distance between the terminal 16 and a printing element 15 provided corresponding to the ejection port array and reduce a low voltage and a signal transmission delay occurring in a wiring portion in the printing element substrate 10. As described above, one ejection module 200 includes the printing element substrate 10 and the flexible wiring substrates 40. The printing element substrate 10 is electrically connected to the printing apparatus body on which the liquid ejection head 3 is mounted via the flexible wiring substrates 40 and the above-described electrical wiring substrates 90.

<Description of the Flow Path Member and the Ejection Module>

Figure 5A:
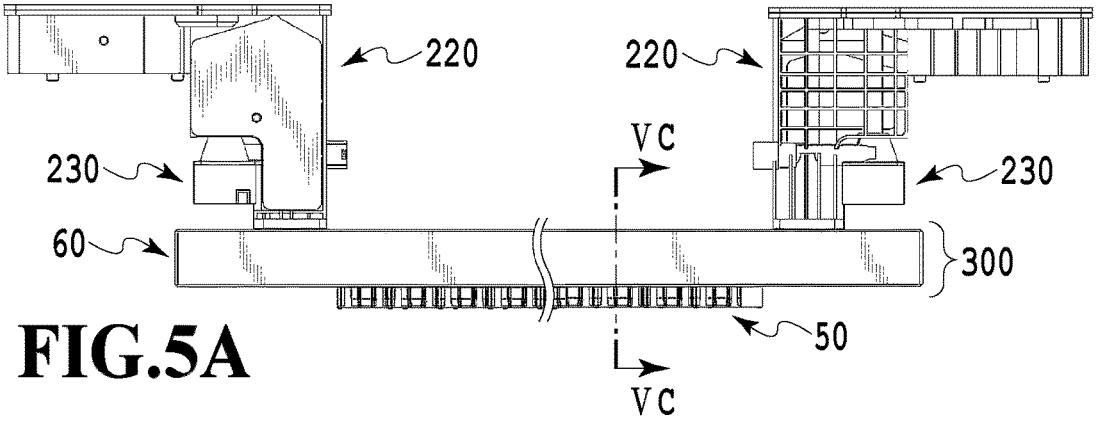
FIGS. 5A to 5C are diagrams illustrating the liquid ejection head.
Figure 5B:
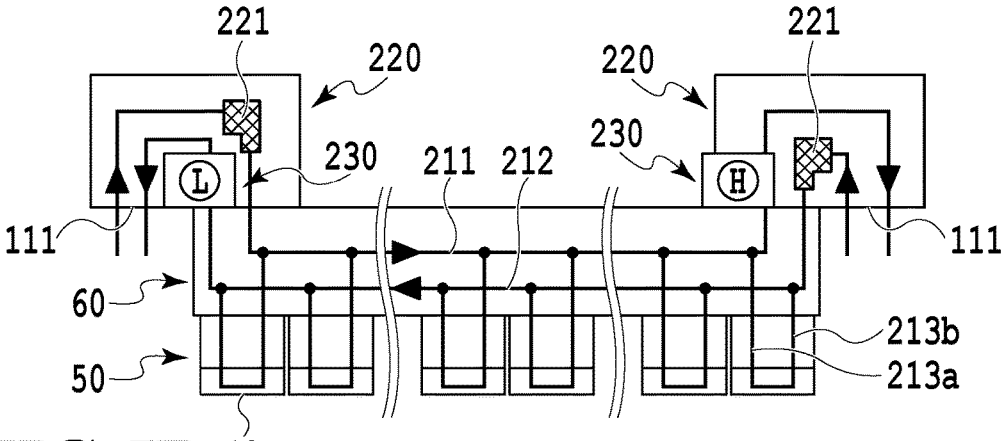
Figure 5C:
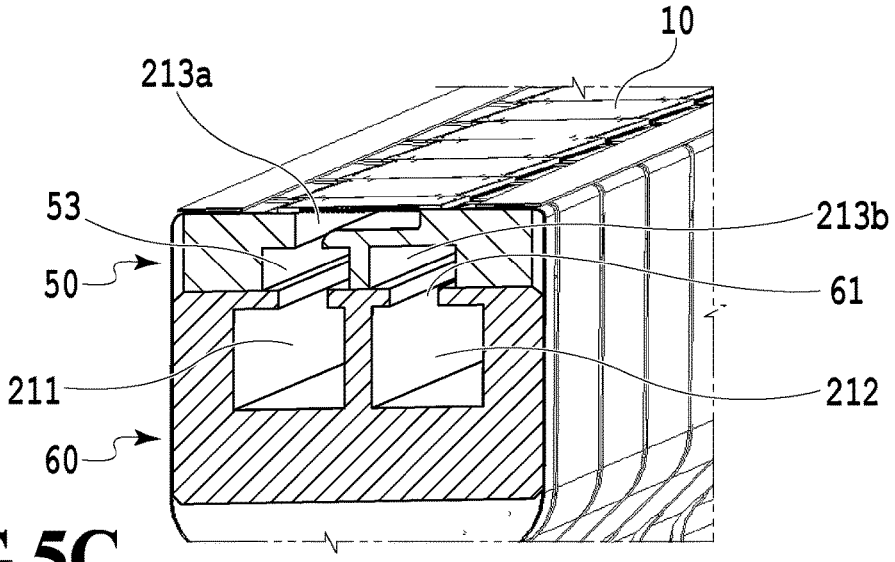

FIG. 5A is a side view of the liquid ejection head 3 having the liquid ejection unit 300, the liquid supply unit 220, and the negative pressure control unit 230. FIG. 5B is a schematic view showing the flow of the liquid. FIG. 5C is a perspective view showing a cross section taken along line VC-VC of FIG. 5A. For convenience in understanding, part of the configuration is simplified.

FIG. 5B is a schematic view showing the flow of a printing liquid inside the liquid ejection head 3. FIG. 5B shows the same circuit as the circulation path shown in FIG. 2, but FIG. 5B shows the actual flow of the liquid in the components of the liquid ejection head 3. Inside the elongate second flow path member 60, there is provided a pair of the common supply flow path 211 and the common collection flow path 212, extending in the longitudinal direction of the liquid ejection head 3. The common supply flow path 211 and the common collection flow path 212 are configured such that the liquid flows therethrough in opposite directions. A filter 221 is provided upstream from each of the flow paths to trap foreign matter entering from a connecting part 111 or the like. As described above, the common supply flow path 211 and the common collection flow path 212 pass the liquid in opposite directions to each other, thereby reducing a temperature gradient in the longitudinal direction inside the liquid ejection head 3. It should be noted that for simplicity of explanation, FIG. 2 shows that the flow in the common supply flow path 211 and the flow in the common collection flow path 212 are in the same direction.

The negative pressure control units 230 are connected to the downstream side of the common supply flow path 211 and the downstream side of the common collection flow path 212, respectively. Further, there are branch parts to a plurality of individual supply flow paths 213*a* in the midstream of the common supply flow path 211, and branch parts to a plurality of individual collection flow paths 213*b* in the midstream of the common collection flow path 212. The individual supply flow path 213*a* and the individual collection flow path 213*b* are formed inside each of a plurality of first flow path members 50, and each individual flow path is in communication with an opening (not shown) of a lid member provided on a back surface of the printing element substrate 10.

The negative pressure control units 230 denoted by H and L in FIG. 5B are a unit on the high-pressure side (H) and a unit on the low-pressure side (L), respectively. The negative pressure control units 230 are back-pressure type pressure adjusting mechanisms configured to control pressure upstream from the negative pressure control units 230 under relatively high (H) and low (L) negative pressures, respectively. The common supply flow path 211 is connected to the negative pressure control unit 230 (high-pressure side) and the common collection flow path 212 is connected to the negative pressure control unit 230 (low-pressure side), which causes a pressure difference between the common supply flow path 211 and the common collection flow path 212. This pressure difference causes the liquid to pass through the individual supply flow path 213*a*, an ejection port (a pressure chamber) inside the printing element substrate 10, and the individual collection flow path 213*b* in this order from the common supply flow path 211 to the common collection flow path 212.

FIG. 5C is a perspective view showing a cross section taken along line VC-VC of FIG. 5A. The printing element substrate 10 having the lid member (not shown) is directly joined to the first flow path member 50. The liquid in the common supply flow path 211 provided in the second flow path member is supplied to the individual supply flow path 213*a*, from a communication port 61 formed on a top surface of the common supply flow path 211, via an individual communication port 53 formed on a bottom surface of the first flow path member 50. Then, the liquid passes through the pressure chamber, the individual collection flow path 213*b*, the individual communication port 53, and the communication port 61 in this order and is collected in the common collection flow path 212.

<Detailed Description of the Ejection Module>

Figure 6:
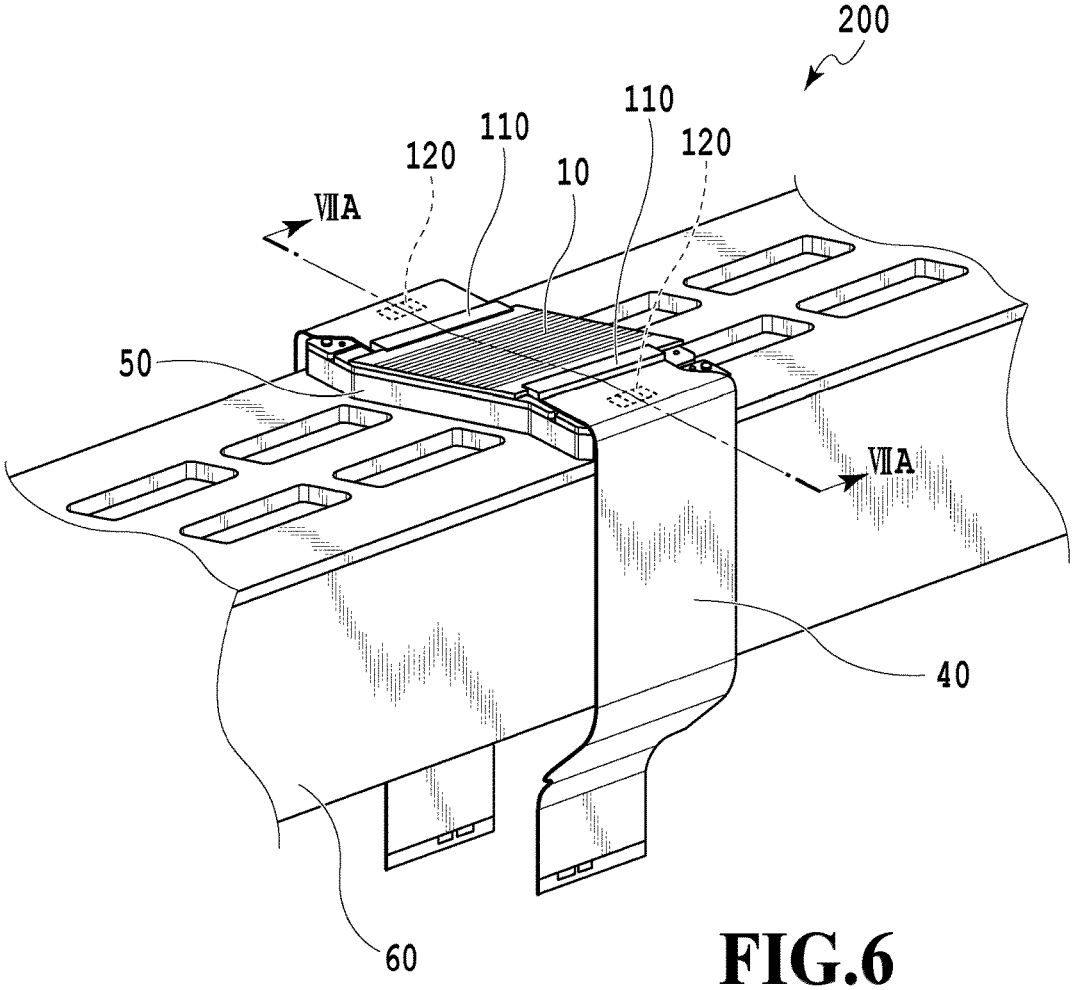
FIG. 6 is a diagram illustrating the details of the ejection module.

FIG. 6 is a diagram illustrating the details of the ejection module 200 of the present embodiment. FIG. 6 shows a state where one individual ejection module 200 is joined to the first flow path member 50 and further to the second flow path member 60.

In the ejection module 200 of the present embodiment, the flexible wiring substrates 40 are connected in two opposite directions of the printing element substrate 10 as shown in FIGS. 4A and 4B. A capacitor 120 is implemented on each of the two flexible wiring substrates 40. The capacitor 120 is provided to prevent a malfunction of a drive element. A periphery of the capacitor 120 is sealed with a sealing agent. The printing element substrate 10 is joined to the first flow path member 50 (a first supporting member) having an ink flow path therein. Furthermore, the first flow path member 50 is joined to the second flow path member 60 (a second supporting member) having an ink flow path therein. Accordingly, a path for the inside ink is configured to communicate from the second flow path member 60 to the printing element substrate 10.

The flexible wiring substrates 40 are bent along both side surfaces of the first flow path member 50 and the second flow path member 60 to minimize an impact on outer dimensions of the inkjet print head. Meanwhile, the capacitor 120 on the flexible wiring substrate 40 is in a position where the capacitor 120 can be housed in a cutout shape provided on each side of the first flow path member 50 and is housed with the sealing agent around the capacitor, so that it does not affect the outer dimensions of the print head.

Figure 7A:
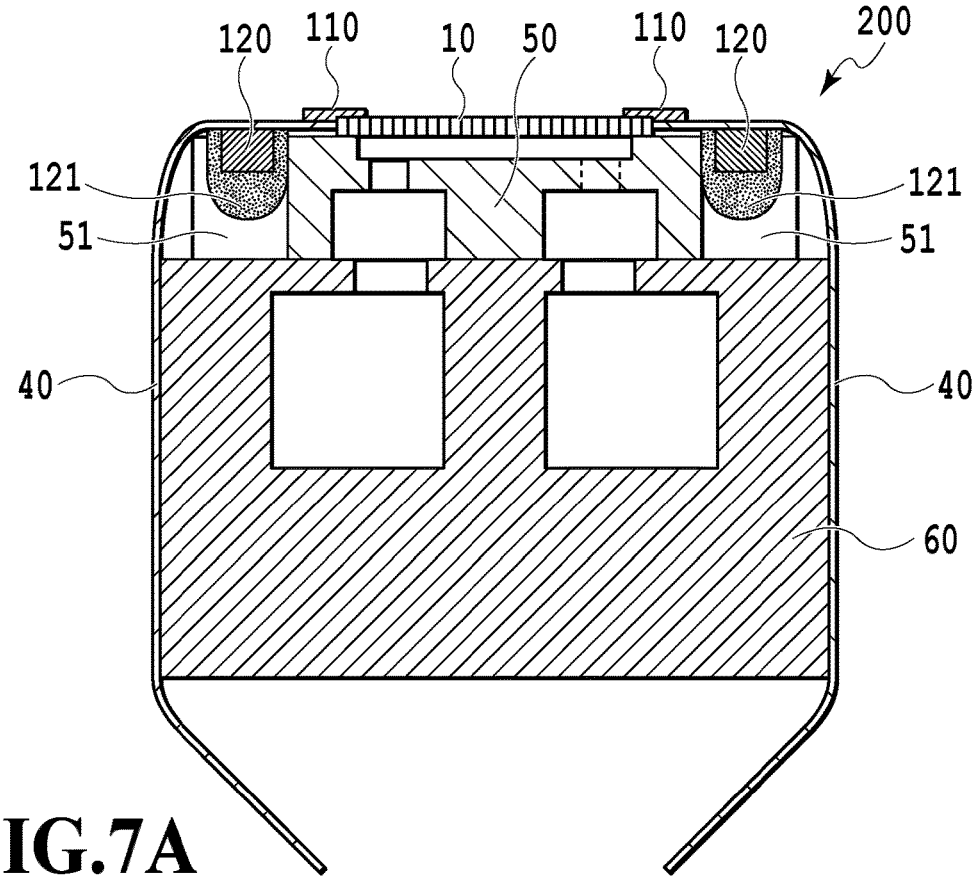
FIGS. 7A and 7B are diagrams illustrating the details of the ejection module.
Figure 7B:
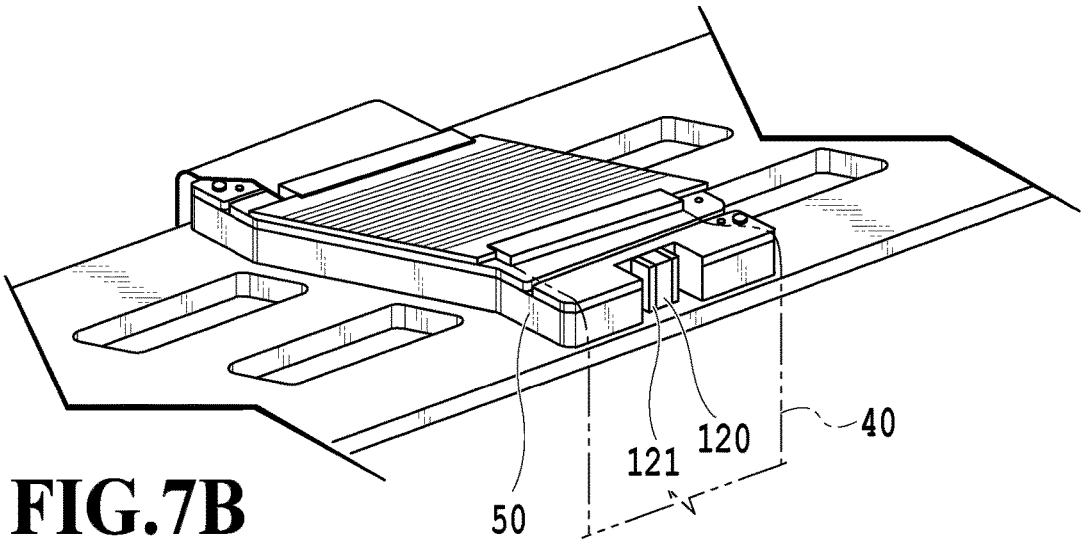

FIG. 7A is a view of a cross section taken along line VIIA-VIIA of the ejection module 200, the first flow path member 50, and the second flow path member 60 of FIG. 6. FIG. 7B is a perspective view in which the flexible wiring substrates 40 of FIG. 6 is in a transparent state. As shown in these figures, the first flow path member 50 has an opening 51 (a recess) that is formed into a U-shape in plan view in a position where the capacitor 120 is housed in each side to which the flexible wiring substrate 40 is joined. The opening 51 is formed so as to penetrate the first flow path member 50 in a laminating direction of FIG. 7A. That is, the opening 51 is recessed to open toward the side surface of the first flow path member 50 and formed as an opening penetrating in the laminating direction.

The capacitor 120 implemented on the flexible wiring substrate 40 is housed in the opening 51 in a state where the flexible wiring substrate 40 is provided along the first flow path member 50 and the second flow path member 60. Furthermore, the capacitor 120 is housed in the opening 51 in a state where the periphery of the capacitor 120 is sealed with a sealing agent 121. To form such states, first, the periphery of the capacitor 120 of the flexible wiring substrate 40 is sealed with the sealing agent 121. Then, the first flow path member 50 and the second flow path member 60 are joined together. Then, the ejection module 200 is joined to these flow path members. As a result, the states shown in FIGS. 7A and 7B are formed.

In this manner, since the capacitor 120 is housed in a cutout shape provided in each side of the first flow path member 50, it does not affect the outer dimensions of the print head. Furthermore, since the capacitor 120 is housed in the opening 51 in a state where the capacitor 120 is sealed with the sealing agent 121, ink contamination can be avoided even if the capacitor 120 is located in the vicinity of the printing element substrate 10 that ejects ink. Moreover, even with external shock due to vibrations or a drop, the sealing agent 121 serves to reduce movement of the capacitor 120 inside the opening 51 of the first flow path member 50, thereby protecting the capacitor.

Second Embodiment

Figure 8A:
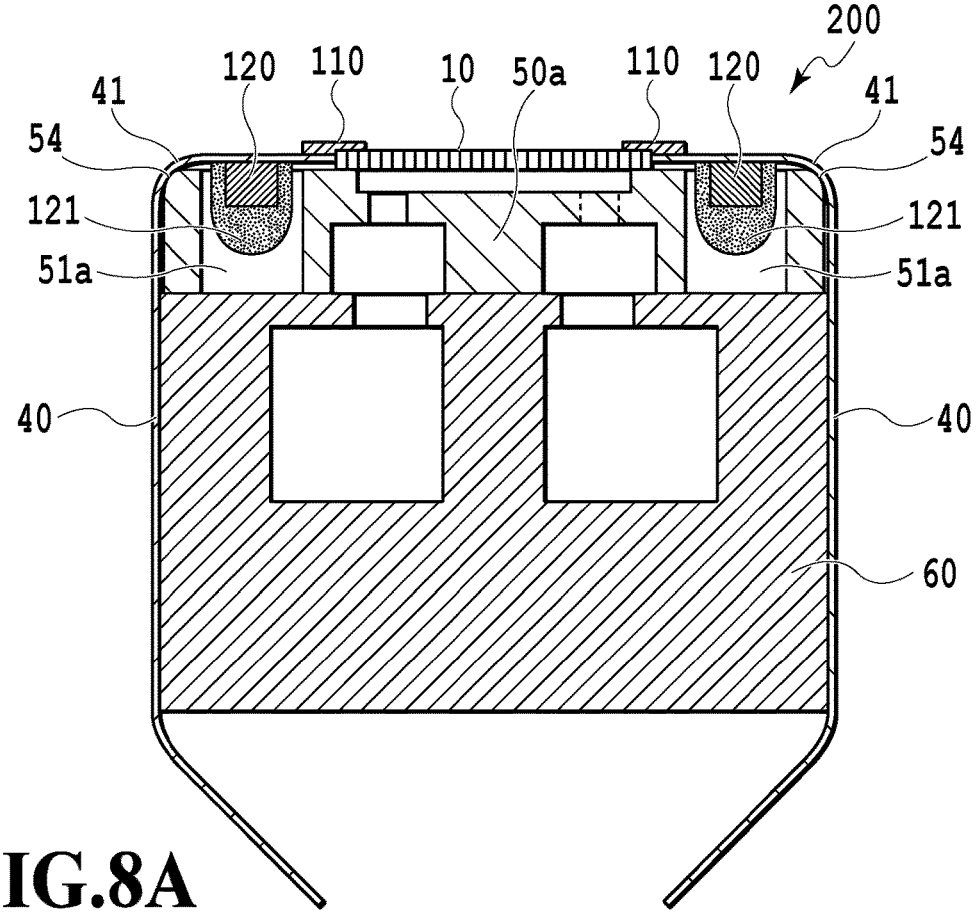
FIGS. 8A and 8B are diagrams illustrating the details of the ejection module.
Figure 8B:
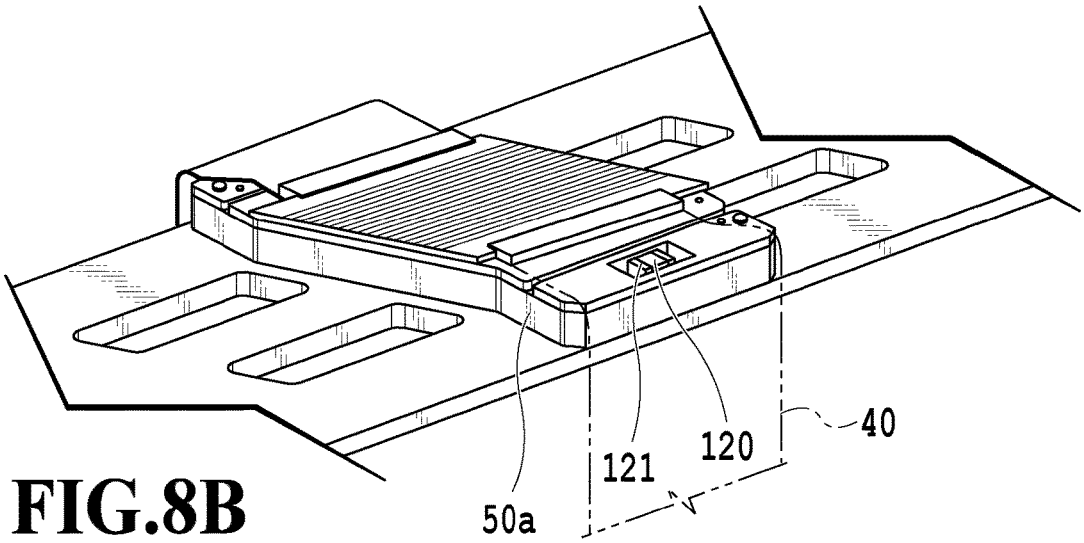

FIGS. 8A and 8B are diagrams showing examples of an ejection module 200, a first flow path member 50*a*, and a second flow path member 60 according to the second embodiment. As in the first embodiment, FIG. 8A is a diagram showing examples of the ejection module 200, the first flow path member 50*a*, and the second flow path member 60. FIG. 8B is a perspective view in which a flexible wiring substrate 40 of FIG. 8A is in a transparent state.

As shown in FIGS. 8A and 8B, in the present embodiment, a recess 51*a* for housing a capacitor of the first flow path member 50*a* is located in an inner position relative to each end of the first flow path member 50*a*. That is, in plan view, the recess 51*a* is not in a U-shape, but in the form of a rectangle. In this manner, the recess 51*a* according to the present embodiment is a recessed opening when the first flow path member 50*a* and the second flow path member 60 are viewed as an integral part. In the present embodiment, the recess 51*a* is located in an inner position relative to each end of the first flow path member 50*a*. Therefore, a ridge line 54 of the first flow path member 50*a*, which contacts the inside of a bent portion 41 of a flexible wiring substrate 40, may be formed by a continuous curve having a desired radius of curvature R across the entire area of the flexible wiring substrate 40 in its width direction.

Typically, the flexible wiring substrate 40 has a shape specific to the inkjet print head in many cases, and is often configured by a dedicated flexible wiring substrate. In terms of the characteristics of the flexible wiring substrate, having a bent portion with an extremely small radius of curvature R may cause cracking on a wiring cover member outside the bent portion due to bending loads, whereby liquid such as ink enters a crack, causing a short between the wiring. According to the present embodiment, a desired radius of curvature R for reducing bending loads on the flexible wiring substrate may be set inside the bent portion of the flexible wiring substrate. Accordingly, cracking outside the bent portion may be prevented and a short between the wiring due to ink entering the crack may be prevented.

Furthermore, a joint between a terminal of the capacitor and a land of the flexible wiring substrate is typically formed by a soldered connection. The joint is soldered with an area needed to ensure strength. In a case where this soldered surface is affected by deformation of the flexible wiring substrate by bending, the joint may fall off. In the present embodiment, since the position of the capacitor on the flexible wiring substrate may be separated from the bent portion of the flexible wiring substrate at a suitable distance, it is also possible to prevent the capacitor joint from falling off.

Third Embodiment

Figure 9:
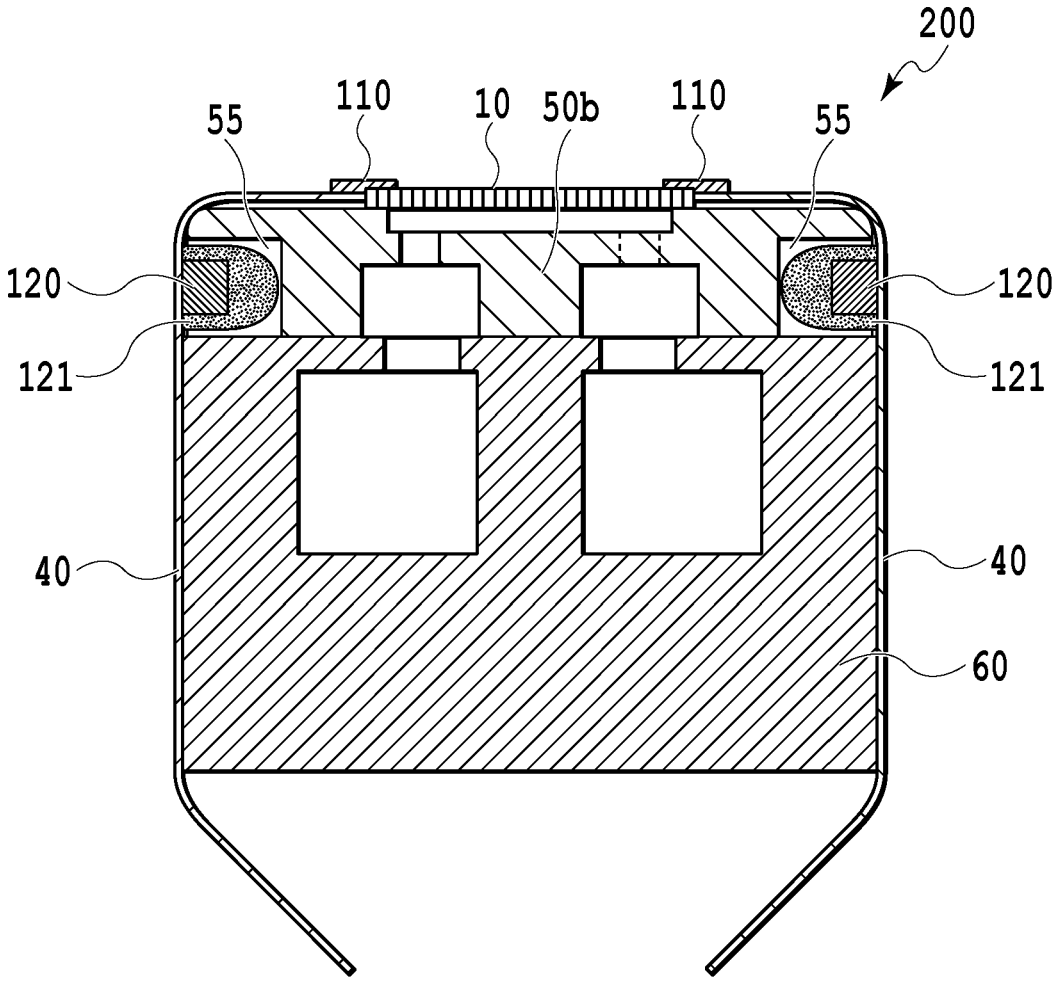
FIG. 9 is a diagram illustrating the details of the ejection module.

FIG. 9 is a diagram showing a cross section of an ejection module 200, a first flow path member 50*b*, and a second flow path member 60 according to the third embodiment. According to the present embodiment, a recess 55 for housing a capacitor of the first flow path member 50*b* is formed on a side surface of each end of the first flow path member 50*b*. That is, the recess 55 according to the present embodiment is recessed to open toward the side surface of the first flow path member 50*b*. Accordingly, having a distance capable of suppressing direct entry of ink from a printing element substrate 10 ejecting ink allows preventing a capacitor 120 from being contaminated with ink. Furthermore, as in the second embodiment, it is also possible to set a desired radius of curvature R that is effective at reducing bending loads on a flexible wiring substrate 40. Moreover, as in the second embodiment, since a capacitor implementation part may be spaced apart from a bent portion of the flexible wiring substrate 40, it is also possible to prevent a capacitor joint from falling off.

Fourth Embodiment

Figure 10:
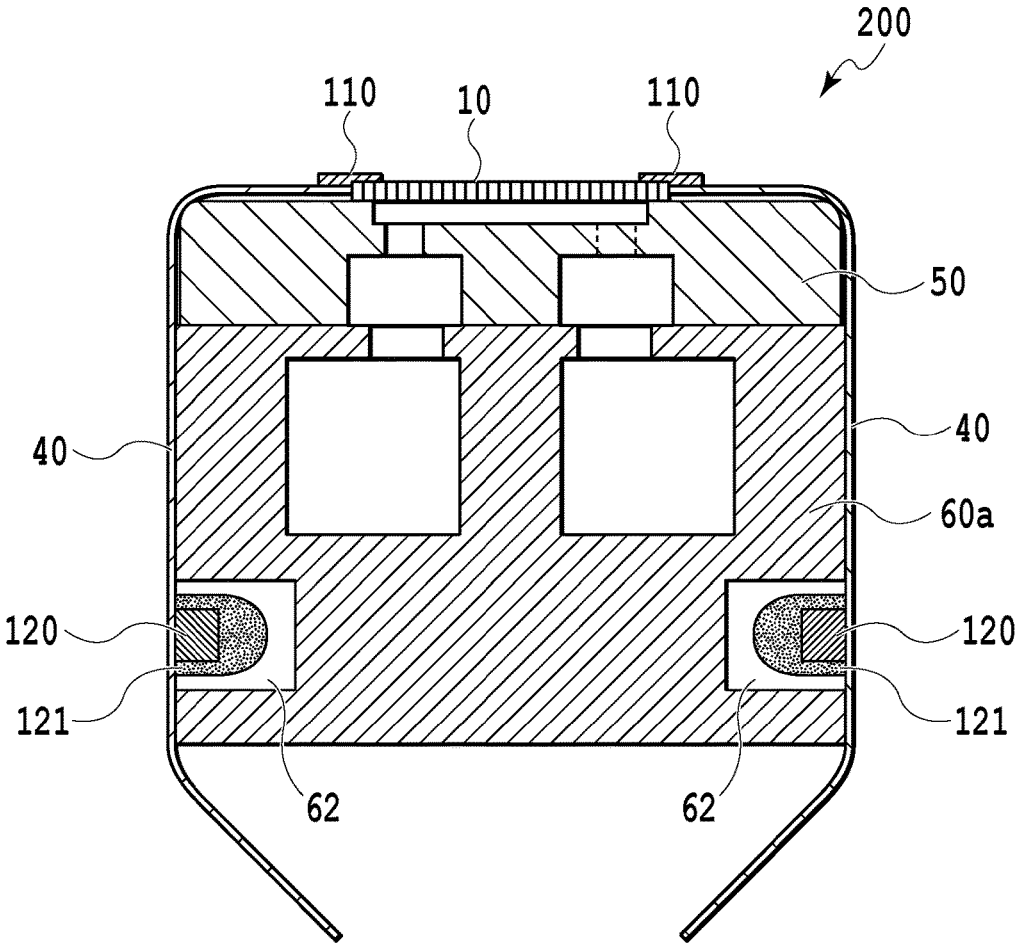
FIG. 10 is a diagram illustrating the details of the ejection module.

FIG. 10 is a diagram showing a cross section of an ejection module 200, a first flow path member 50, and a second flow path member 60*a* according to the fourth embodiment. According to the present embodiment, a recess 62 for housing a capacitor is formed on a side surface of each end of the second flow path member 60*a*, not the first flow path member 50. Accordingly, having a distance capable of suppressing direct entry of ink from a printing element substrate 10 ejecting ink allows preventing a capacitor 120 from being contaminated with ink. Furthermore, as in the second and third embodiments, it is also possible to set a desired radius of curvature R that is effective at reducing bending loads on a flexible wiring substrate 40. Moreover, since a capacitor implementation part may be spaced apart from a bent portion of the flexible wiring substrate 40, it is also possible to prevent a capacitor joint from falling off.

Fifth Embodiment

Figure 11:
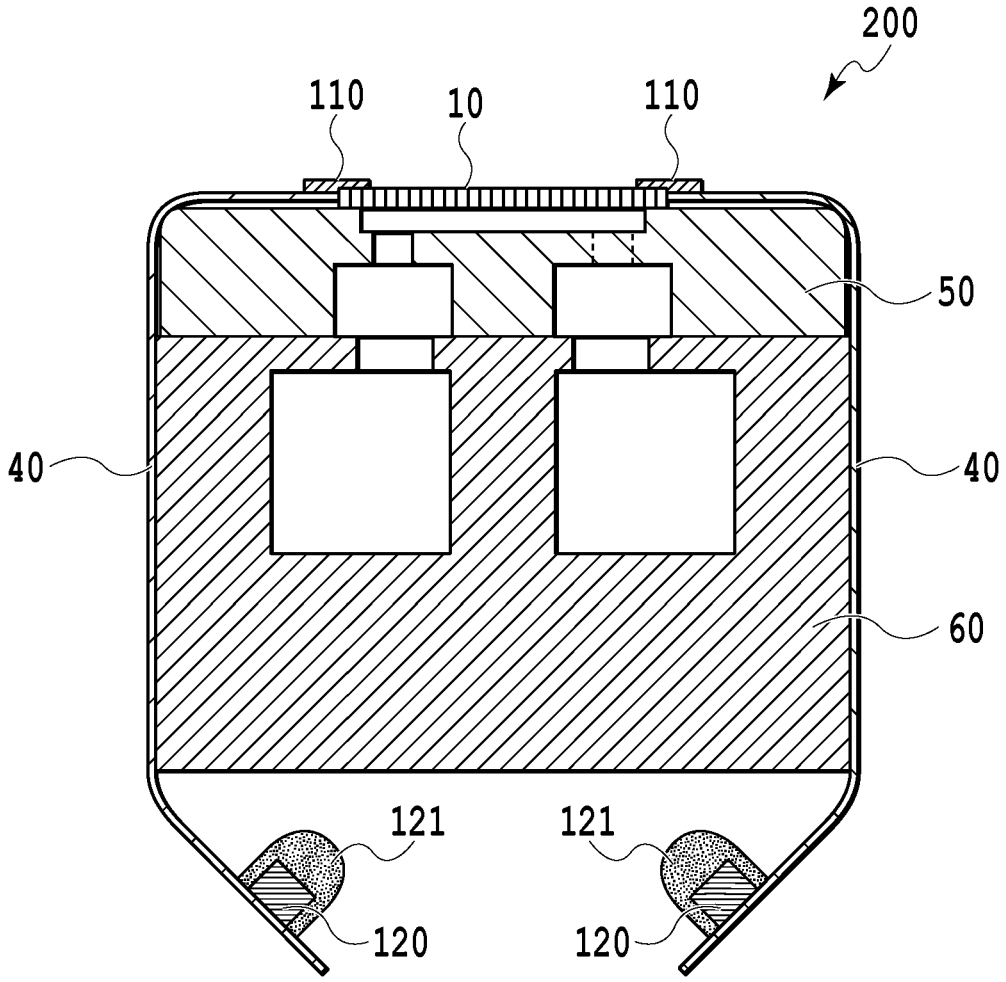
FIG. 11 is a diagram illustrating the details of the ejection module.

FIG. 11 is a diagram showing a cross section of an ejection module 200, a first flow path member 50, and a second flow path member 60 according to the fifth embodiment. According to the present embodiment, a capacitor 120 of a flexible wiring substrate 40 is located farther than the second flow path member 60. That is, the capacitor 120 sealed with a sealing agent 121 is located in a hollow manner, opposite to the direction in which the first flow path member 50 is laminated to the second flow path member 60. Accordingly, having a distance capable of suppressing direct entry of ink from a printing element substrate 10 ejecting ink allows preventing the capacitor 120 from being contaminated with ink. Furthermore, as in the second to fourth embodiments, it is also possible to set a desired radius of curvature R that is effective at reducing bending loads on the flexible wiring substrate 40. Moreover, since a capacitor implementation part may be spaced apart from a bent portion of the flexible wiring substrate 40, it is also possible to prevent a capacitor joint from falling off.

According to the present embodiment, since a capacitor may be provided in a large space without being housed in a recess provided on the first flow path member 50 or the second flow path member 60, it is possible to secure a sufficient area to which the sealing agent 121 is applied around the capacitor and reduce restrictions in application such as management of application amounts and control of application positions.

As described above, it is possible to prevent the capacitor of the print head from being contaminated with ink in any of the configurations according to the first to fifth embodiments. Moreover, it is possible to achieve protection of the capacitor and the capacitor implementation part from shock of vibrations or a drop. Therefore, a highly reliable inkjet print head can be provided.

Other Embodiments

Description has been given of the examples of the aspects of the ejection modules in the above-described embodiments that two flexible wiring substrates are connected to one printing element substrate, but the present invention is not limited to this. The same effect can be obtained by an ejection module in which one flexible wiring substrate is connected to one printing element substrate.

As described above, the capacitor provided on the ejection module of the inkjet print head tends to have a greater electrical effect as it becomes closer to the printing element substrate. However, in the actual design, it is effective to select an optimum position of the capacitor in designing by taking into consideration various restrictions such as preventing ink contamination, preventing external shock, or preventing the flexible wiring substrate from falling off due to bending shape.

In the above-described embodiments, the example of the capacitor has been described mainly, but the present invention is not limited to this. It is possible to employ an aspect that any electronic component on the flexible wiring substrate is sealed with a sealing agent and housed as in the above-described embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-097416, filed May 16, 2017, which is hereby incorporated by reference herein in its entirety.

What is claimed is:

1. An inkjet print head comprising:

an ejection module having a printing element substrate that ejects ink to a print medium and a flexible wiring substrate electrically connected to the printing element substrate; and a member for supporting the ejection module by joining thereto, wherein the flexible wiring substrate has a capacitor, the capacitor being covered with a sealing agent such that the sealing agent contacts the capacitor, and the capacitor is provided in a recess formed on the member.

2. The inkjet print head according to claim 1, wherein the capacitor and the sealing agent are located inside a space surrounded by the recess and the flexible wiring substrate.

3. The inkjet print head according to claim 1, wherein the flexible wiring substrate has a bent portion, and the capacitor is located in a position separated from the bent portion.

4. The inkjet print head according to claim 1, wherein the member includes a first member for supporting the ejection module and a second member for supporting the first member, the first member and the second member being laminated to each other, and the recess is formed on either of the first member and the second member.

5. The inkjet print head according to claim 4, wherein the flexible wiring substrate is joined along each side surface of the first member and the second member, the side surface of the first member corresponding to a surface adjacent to a surface facing the ejection module in the first member and the side surface of the second member corresponding to a surface adjacent to a surface facing the ejection module in the second member.

6. The inkjet print head according to claim 4, wherein the first member is a first flow path member forming a flow path for supplying the ink to the printing element substrate, and the second member is a second flow path member for supplying the ink to the first flow path member.

7. The inkjet print head according to claim 4, wherein the recess is open toward a side surface of the first member and is formed as an opening penetrating in a laminating direction in which the first member and the second member are laminated to each other, the side surface of the first member corresponding to a surface adjacent to a surface facing the ejection module in the first member.

8. The inkjet print head according to claim 4, wherein the recess is formed as an opening penetrating the first member in a laminating direction in which the first member and the second member are laminated to each other.

9. The inkjet print head according to claim 4, wherein the recess is open toward a side surface of the first member, the side surface of the first member corresponding to a surface adjacent to a surface facing the ejection module in the first member.

10. The inkjet print head according to claim 4, wherein the recess is open toward a side surface of the second member, the side surface of the second member corresponding to a surface adjacent to a surface facing the ejection module in the second member.

11. The inkjet print head according to claim 4, wherein the recess corresponds to a notch arranged in a side surface of the first member, the side surface of the first member corresponding to a surface adjacent to a surface facing the ejection module in the first member.

12. The inkjet print head according to claim 1, comprising a plurality of ejection modules, wherein the member for supporting supports the plurality of ejection modules by joining them together, and the flexible wiring substrate corresponding to each of the ejection modules has the capacitor.

13. The inkjet print head according to claim 12, wherein the member includes a plurality of a first members for supporting the plurality of ejection modules, respectively, and a second member for supporting the plurality of the first members.

14. The inkjet print head according to claim 1, wherein the inkjet print head is a page wide type.

15. The inkjet print head according to claim 1, wherein an exposed portion of the capacitor is enclosed with the sealing agent.

16. The inkjet print head according to claim 1, wherein the capacitor is implemented on a surface of the flexible wiring substrate, the surface of the flexible wiring substrate facing the member.

17. The inkjet print head according to claim 1, wherein the ejection module has a plurality of flexible wiring substrates, each electrically connected to the printing element substrate, and the plurality of flexible wiring substrates have a capacitor, respectively.

18. An inkjet print head comprising:

an ejection module having a printing element substrate that ejects ink to a print medium and a flexible wiring substrate electrically connected to the printing element substrate; and a member for supporting the ejection module by joining thereto, the member including a first member and a second member that are laminated to each other, wherein the flexible wiring substrate has a capacitor, the capacitor being covered with a sealing agent such that the sealing agent contacts the capacitor, and the capacitor is located in a hollow manner, opposite to a direction in which the first member is laminated to the second member.

19. An inkjet printing apparatus comprising:

an inkjet print head having:

an ejection module having a printing element substrate that ejects ink to a print medium and a flexible wiring substrate electrically connected to the printing element substrate, and a member for supporting the ejection module by joining thereto, wherein the flexible wiring substrate has a capacitor, the capacitor being covered with a sealing agent such that the sealing agent contacts the capacitor, and the capacitor is provided in a recess formed on the member; and an apparatus body electrically connected to the inkjet print head via the flexible wiring substrate.

* * * * *